US010854980B2

(12) United States Patent
Furlan

(10) Patent No.: US 10,854,980 B2
(45) Date of Patent: Dec. 1, 2020

(54) PLANAR INVERTED F-ANTENNA

(71) Applicant: Taoglas Group Holdings Limited, San Diego, CA (US)

(72) Inventor: Vladimir Furlan, Munich (DE)

(73) Assignee: TAOGLAS GROUP HOLDINGS LIMITED, Enniscorthy (IE)

( * ) Notice: Subject to any disclaimer, the term of this patent is extended or adjusted under 35 U.S.C. 154(b) by 0 days.

(21) Appl. No.: 16/572,270

(22) Filed: Sep. 16, 2019

(65) Prior Publication Data

US 2020/0014111 A1 Jan. 9, 2020

Related U.S. Application Data

(63) Continuation of application No. 15/904,751, filed on Feb. 26, 2018, now Pat. No. 10,418,709.

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 5/371*** | (2015.01) |

(52) U.S. Cl.

CPC ..... *H01Q 9/0421* (2013.01); *H01Q 1/244* (2013.01); *H01Q 5/371* (2015.01); *H01Q 9/42* (2013.01)

(58) Field of Classification Search

None

See application file for complete search history.

(56) References Cited

U.S. PATENT DOCUMENTS

| | | | | |
|---|---|---|---|---|
| 6,639,560 | B1 * | 10/2003 | Kadambi | H01Q 1/243 343/700 MS |
| 6,850,200 | B2 | 2/2005 | Tracy et al. | |
| 7,099,690 | B2 | 8/2006 | Milosavljevic | |
| 9,136,594 | B2 | 9/2015 | Shi et al. | |
| 9,608,329 | B2 | 3/2017 | Liu et al. | |
| 2004/0085244 | A1 * | 5/2004 | Kadambi | H01Q 9/0421 343/700 MS |

(Continued)

FOREIGN PATENT DOCUMENTS

| | | | | |
|---|---|---|---|---|
| FR | 2825837 | A1 * | 12/2002 | H01Q 1/243 |

OTHER PUBLICATIONS

Lui, et al. "Miniature PIFA without empty space for 2.4 GHz ISM band applications", Abstract, IEEE, Electronics f-etters, vol. 46, Issue: 2, Jan. 21, 2010.

*Primary Examiner* — Howard Williams

(74) *Attorney, Agent, or Firm* — Garson & Gutierrez, PC

(57) ABSTRACT

A Planar Inverted-F Antenna, PIFA, comprises a sheet of conductive material including first, second, third and fourth contiguous sections, the first and third sections extending orthogonally away from the second section and the fourth section extending away from the third section. The sections are folded relative to one another to define a volume with a heights of the second section, a width of the second section, and a depth of the third section extending away from the second section. A supporting pin and a feed pin extend from the second section along an outer edge. A supporting leg extends from either the third or fourth sections, the supporting leg lying outside the plane of the supporting pin to support the PIFA when mounted on a printed circuit board, while allowing components to at least partially occupy the volume under the PIFA.

20 Claims, 5 Drawing Sheets

(56) References Cited

U.S. PATENT DOCUMENTS

| | | | | |
|---|---|---|---|---|
| 2011/0043408 | A1* | 2/2011 | Shi | H01Q 1/48<br>343/700 MS |
| 2016/0149303 | A1* | 5/2016 | Mcgough | H01Q 9/0421<br>343/767 |
| 2017/0062933 | A1* | 3/2017 | Wu | H01Q 9/0428 |

* cited by examiner

PLANAR INVERTED F-ANTENNA

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

All publications, patents, and patent applications mentioned in this specification are herein incorporated by reference to the same extent as if each individual publication, patent, or patent application was specifically and individually indicated to be incorporated by reference.

BACKGROUND

Field

The present application relates to a Planar Inverted-F Antenna (PIF A) which in use provides a multiple band frequency response.

Description of the Related Art

U.S. Pat. No. 9,136,594 B2 discloses a multi-band PIF A including two arm portions, where one arm portion is grounded at two points to form a loop, a ground plane, and a plastic carrier and housing. The antenna radiates a same signal from both arm portions, at different efficiencies according to the radiated frequency and the effective length of each arm. The antenna is made from a single standard metal sheet by cutting it and is assembled with the metal ground plane and the other plastic parts. In one embodiment, the antenna is folded into a 3D U-shape to reduce its size for use in mobile communication devices. The antenna can be a penta-band antenna with return loss of −6 B or better and measures 40 mm×8 mm×8 mm or smaller.

U.S. Pat. No. 9,608,329 B2 discloses a multiband antenna device comprising a conductive elongate antenna element configured for electrical connection to a conductive ground plane at a grounding point, and for electrical connection to a radio transmitter/receiver at a feeding point. The antenna element comprises a first portion and a second portion. The first portion is configured to extend in a first direction along a first outside edge of the ground plane, and then in a second direction along a second outside edge of the ground plane. The second portion of the antenna element is configured to double back next to the first portion in a third, substantially counter-parallel direction back along the second outside edge of the ground plane, and then in a fourth direction along the first outside edge of the ground plane. The second portion of the antenna element terminates with a high impedance portion, and the high impedance portion of the antenna element is positioned between the first edge of the ground plane and the first portion of the antenna element so as to form a narrow gap that electromagnetically couples the first and second portions of the antenna element.

LUI, et al. "Miniature PIF A without empty space for 2.4 GHz ISM band applications," IEEE, Electronics Letters, Vol. 46, Issue: 2, Jan. 21, 2010 discloses an antenna fabricated on an FR4 substrate with an overall size of only 10×3×3.5 mm3 to be embedded inside portable devices. Circuit routing on a PCB is permitted underneath and around the antenna. The impedance bandwidth of the antenna is about 160 MHz from 2.39 to 2.55 GHz.

U.S. Pat. No. 7,099,690 B2 discloses a multi-band planar antenna where on a surface of a dielectric part, there is placed a conductive element having a significant electromagnetic coupling to a radiating plane.

U.S. Pat. No. 6,850,200 B2 discloses a compact PIF A including a first arm and a parallel second arm connected by a conductive bridge. An RF feed is attached to one end of the first arm and is used to physically and electrically mount the PIF A An opposite end of the PIF A includes a support structure that provides stability and support of the PIF A during construction of a circuit board on which it is mounted.

SUMMARY

An aspect of the disclosure is directed to planar inverted-F antennas (PIF A). Suitable PIF As comprise a sheet of conductive material including first, second, third and fourth contiguous sections, the first and third sections extending orthogonally away from the second section and the fourth section extending away from the third section, the sections being folded relative to one another to define a volume with a height of the second section, a width of the second section and a depth of the third section extending away from the second section, the second section comprising: a shorting leg divided from a remainder of the second section by a slot, the shorting leg running along a first outer edge of the second section opposite the third section, the shorting leg terminating in a shorting pin extending from a second outer edge of the second section opposite the first section; a feed pin extending from the remainder of the second section along the second outer edge; and at least one supporting pin extending from the remainder of the second section along the second outer edge, each of the feed pin and the at least one supporting pin being bent out of the plane of the second section; the first section having defined therein an L-shaped slot comprising a first leg running adjacent a first outer edge of the first section extending from the first outer edge of the second section and a second leg running adjacent a second outer edge of the first section opposite the second section to define a path extending from the shorting leg around the periphery of the antenna; the third and fourth sections comprising a narrowed arm extending along an inner edge adjacent and running around the folded first section; and at least one further supporting leg extending from either the third or fourth sections away from the inner edge, the supporting leg lying outside the plane of the at least one supporting pin to support the PIF A when mounted on a printed circuit board, while allowing components to at least partially occupy the volume under the PIF A In at least some configurations, a pair of supporting legs extend from adjacent an end of the fourth section remote from the third section. One of the supporting legs can extend from the third section adjacent the second section. Additionally, the third section extends to a greater depth than the first section away from the second section. The fourth section is configurable to extend away from the third section no longer than the width of the second section. In at least some configurations, the sheet is either stamped or laser cut. Suitable configurations have a height of about 20 mm, a width in a range from about 36 mm to about 45 mm and a depth in a range from about 40 mm to 42.5 mm. In some configurations, two supporting pins can be provided which extend from the remainder of the second section along the second outer edge, the two supporting pins being disposed on either side of the feed pin.

Another aspect of the disclosure is directed to electronic assemblies. Suitable electronic assemblies comprise a PCB, on which a PIF A is mounted and including at least one further component mounted on the PCB at least partially occupying the volume under the PIF A The electronic assemblies can also have at least one component has a height no greater than a height of the second section. Additionally, one component of the electronic assembly can have a height no greater than a spacing of the third and fourth sections from the PCB.

Still other aspects of the disclosure are directed to methods of using the PIF As and electronic assemblies and kits therefor.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION

Figure 1:
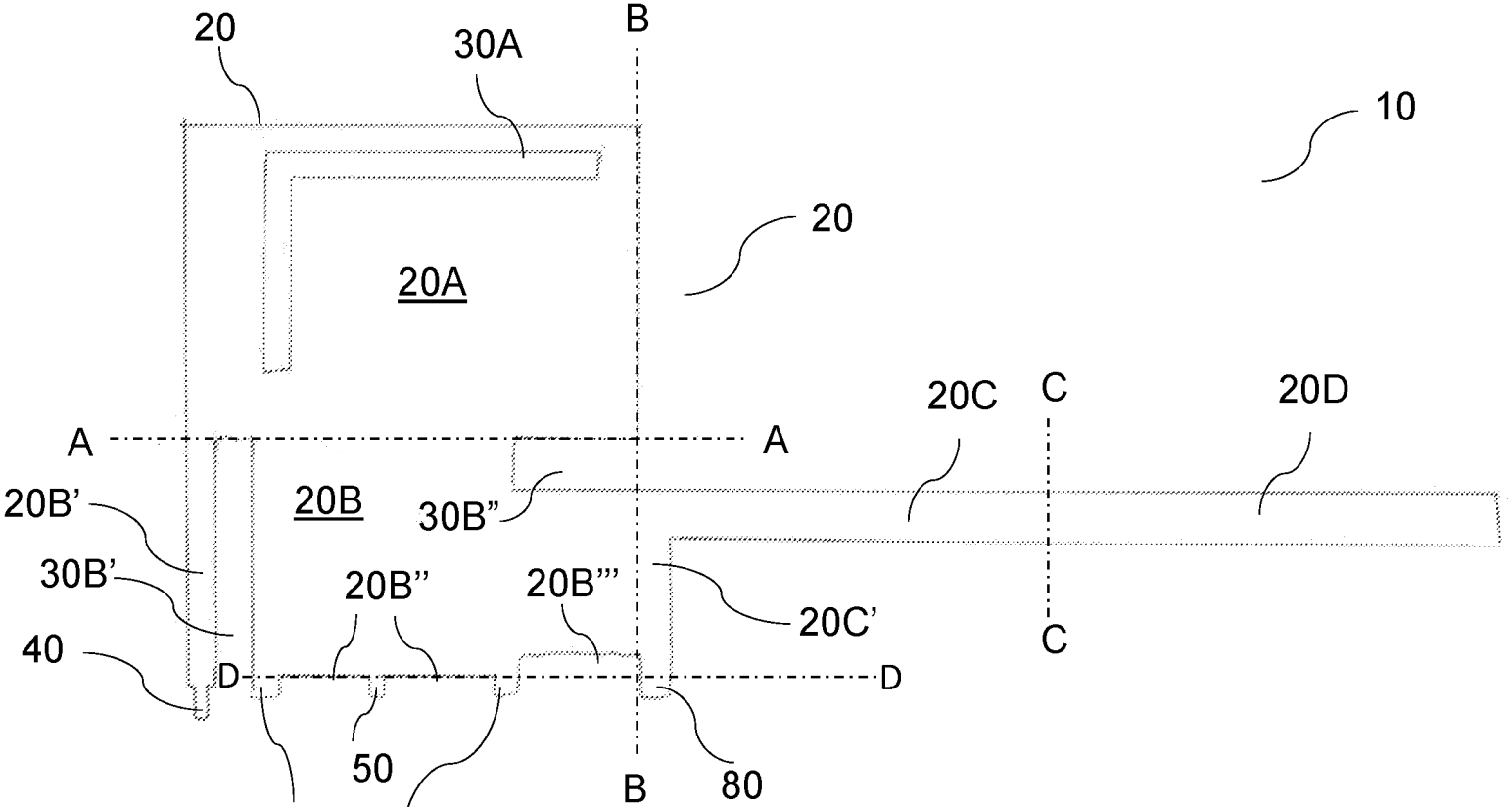
FIG. 1 is a development of a PIF A according to a first embodiment of the present teaching.

It will be appreciated that for simplicity and clarity, where considered appropriate, reference numerals may be repeated among the figures to indicate corresponding or analogous elements.

FIG. 1 illustrates an exemplary PIF A 10 for receiving, transmitting or both receiving and transmitting radio frequency signals according to an embodiment of the present invention in an unfolded state. The PIF A 10 may be configured for use in, for example, $4^{th}$ Generation (4G), $3^{rd}$ Generation (3G) and $2^{nd}$ Generation (2G) wireless frequency bands operating with high efficiency over the frequency band ranges of 698 MHZ to 960 MHz and 1710 MHz to 2700 MHz. The PIF A 10 may be formed by stamping out or laser cutting a planar piece of conductive material, such as metal, to provide the unfolded antenna shape shown. Typically, the material is about 0.5 mm thick.

When unfolded as shown, the PIF A 10 comprises a generally L-shaped body 20 divided along its length into first 20A, second 20B, third 20C and fourth 20D contiguous sections each separated from one another by fold lines A-A, B-B and C-C. The first section 20A occupies a short-leg of the body 20 while the third and fourth sections 20C and 20D extend along a longer leg of the body 20 away from the second section 20B which shares common boundaries with the first and third sections along fold lines A-A, and B-B, respectively.

An inner edge of the L-shaped body 20 extends generally along the edges of the first, third and fourth sections, whereas an outer edge of the body 20 extends generally along the opposite edges of the first, second, third and fourth sections.

In relation to the first section 20A, an L-shaped slot 30A is defined, the slot 30A comprising one leg extending alongside and adjacent the outer edge of the first section 20A and a second leg extending alongside and adjacent a distal edge of the first section 20A, remote from the second section 20B. This slot 30A enables the high frequency response of the PIF A 10 to be tuned to provide the required efficiency at a number of different higher frequencies, for example, in a frequency range from 1710 MHz to 2700 MHz.

In the first embodiment, the third and fourth sections 20C and 20D comprise a relatively slim arm extending away from the second section 20B with these sections determining a low frequency response of the PIF A 10, for example, in a frequency range from 698 MHZ to 960 MHz. While in this embodiment, the fourth section 20D simply extends the third section 20C, the third section 20C widens to provide a base portion 20C' which meets the second section 20B along the fold line B-B.

The second section 20B provides a hub for the PIF A 10, from which the first and third/fourth sections extend and through which the PIF A 10 is mounted to a printed circuit board (PCB)—not shown.

To this end, a number of pins 40, 50, 60 and 70 are defined along one outer edge of the second section 20B with a further pin 80 being defined at the end of the base portion 20C' in line with the pins 40-70.

A pair of slots 30B' and 30B' are defined within the second section 20B. The slot 30B' extends from between the pins 40 and 60 to the fold line A-A The slot 30B" extends inwards from a corner of the inner edge of the body 20 along the fold line A-A. The depth of the slot 30B" is less than the depth of the slot 30B'.

While the slot 30B" is used for tuning the response of the PIF A 10, the slot 30B' defines a longitudinal arm 20B' running along the outside edge of the second section 20B, the arm 20B' functioning as a shorting leg for the PIF A 10 with pin 40 providing a shorting pin at a distal end of the shorting leg for shorting the PIF A 10 to a ground plane of a PCB. It will be seen that the shorting leg 20B' extends in a path around the outer periphery of the L-shaped slot 30A.

Figure 3:
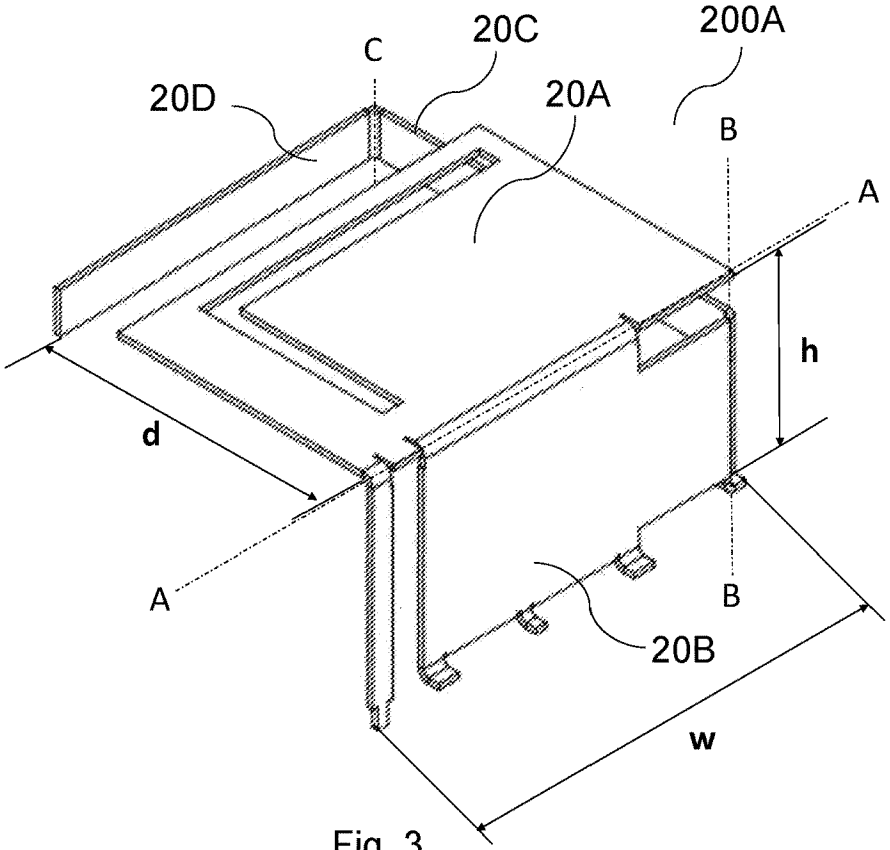
FIG. 3 is a second perspective view of the PIF A of FIG. 1 when folded.
Figure 2:
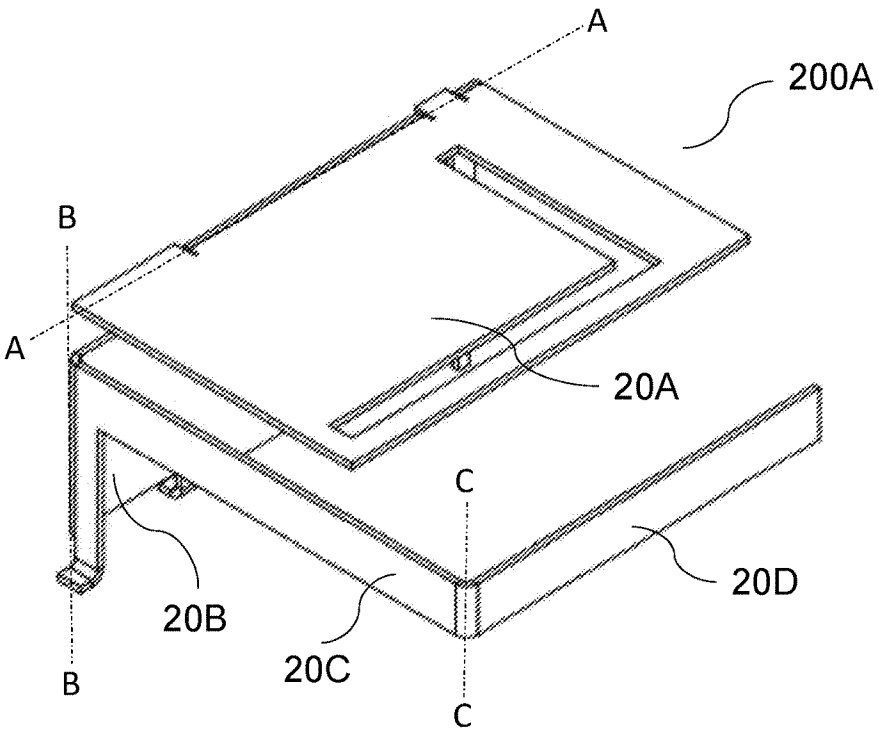
FIG. 2 is a first perspective view of the PIF A of FIG. 1 when folded.

Note that the pin 40 extends further than the pins 50-80 and furthermore, as will be seen in FIGS. 2 and 3, the pin 50-80 are bent 90° out of the plane of the second section 20B along a fold line D-D which runs parallel to fold line A-A to provide mounting feet as well as a feed connection for the PIF A 10 when located on a PCB. The shorting pin 40 on the other hand is not bent and may be located in a cut-out, or through-hole of the PCB so as to aid in the placement of the PIF A 10 onto the PCB. This enables the shorting pin to connect with a ground plane provided on a layer of the PCB spaced away from the surface on which the PIF A 10 is mounted.

Running along the edge of the second section 20B from the shorting pin 40, pins 60 and 70 when bent away from the plane of the second section 20B and located on a PCB act as supporting feet for the PIF A Cut-away portions 20B" along the edge between pins 60 and 70 define a feed pin 50 which can also be bent in the same manner as pins 60, 70.

The support pin 80 is separated from the pin 70 by a deeper cut-away portion 20B"' than the cut-away portions 20B". It will be seen that, as support pin 80 lies on the other side of the fold line B-B from pins 50-70, when the third section 20C is bent out of the plane of the second section 20B, the bent support pin 80 will tend to support the second section 20B in an upright position relative to the PCB so providing mechanical stability for the PIF A as it is being assembled and when integrated onto a PCB. Nonetheless, as the pin 80 is immediately adjacent the second section 20B, it does not unduly limit the placement of other components as will be explained in due course.

The blank PIF A 10 shown in FIG. 1 is bent along fold line D-D to provide the support pins 50-80 before being bent along line B-B. Other than that, the order of folding along lines A-A to D-D is not critical.

Referring now to FIGS. 2 and 3, folds along lines A-A and B-B, fold the first section 20A and third section 20C towards one another to provide a side and top surface of the folded PIF A 200A when mounted on the PCB. The fourth section 20B is further folded in the same direction as the fold B-B so that the fourth section 20D lies in parallel spaced apart relationship with the second section 2B. The folded sections 20A-20D therefore form the PIF A 200A arranged to enclose a volume when mounted on a PCB where the pins 40-80 may then be soldered into position including connecting the pin 50 to a feed line.

Referring specifically to FIG. 3, a rectangular area of PCB occupied by the PIF A 200A measures w×d $mm^2$: with w corresponding to the length of the edge of the first section 20A including the pins 40-70; and d corresponding to the length of the third section 20C. When integrated onto a PCB, the height of an enclosure required to accommodate the PIF A 200A is greater than h mm with h corresponding to the length of the edge of the second section 20B between fold lines B-Band D-D. In the illustrated embodiment of FIG. 3, w=36–45 mm; d=40–42.50 mm; and h=20 mm.

When integrated onto a PCB the volume enclosed by the PIF A 200A allows electronic components to be placed under the PIF A 200A without affecting the radiating or reception performances of the PIF A This saves valuable space on the remainder of the PCB. Furthermore, the ground plane of the PCB may extend under at least a portion of the PIF A 10 without affecting the radiating or reception performances of the PIF A.

In more detail, for the size of PIF A 200A indicated above, components with a height of up to 14 mm may be placed within the PIF A 200A under the first section 200A without affecting the antenna radiating and reception performances. Note however, that components (not shown) with a height of up to 8 mm may be placed under the third section 20C i.e., bridging the space enclosed by the PIF A 200A and the space outside, and components (not shown) with a height of up to 4.4 mm may be placed under the fourth section 20D, again bridging the space enclosed by the PIF A 200A and the space outside, without affecting the antenna radiating and reception performances.

Figure 7:
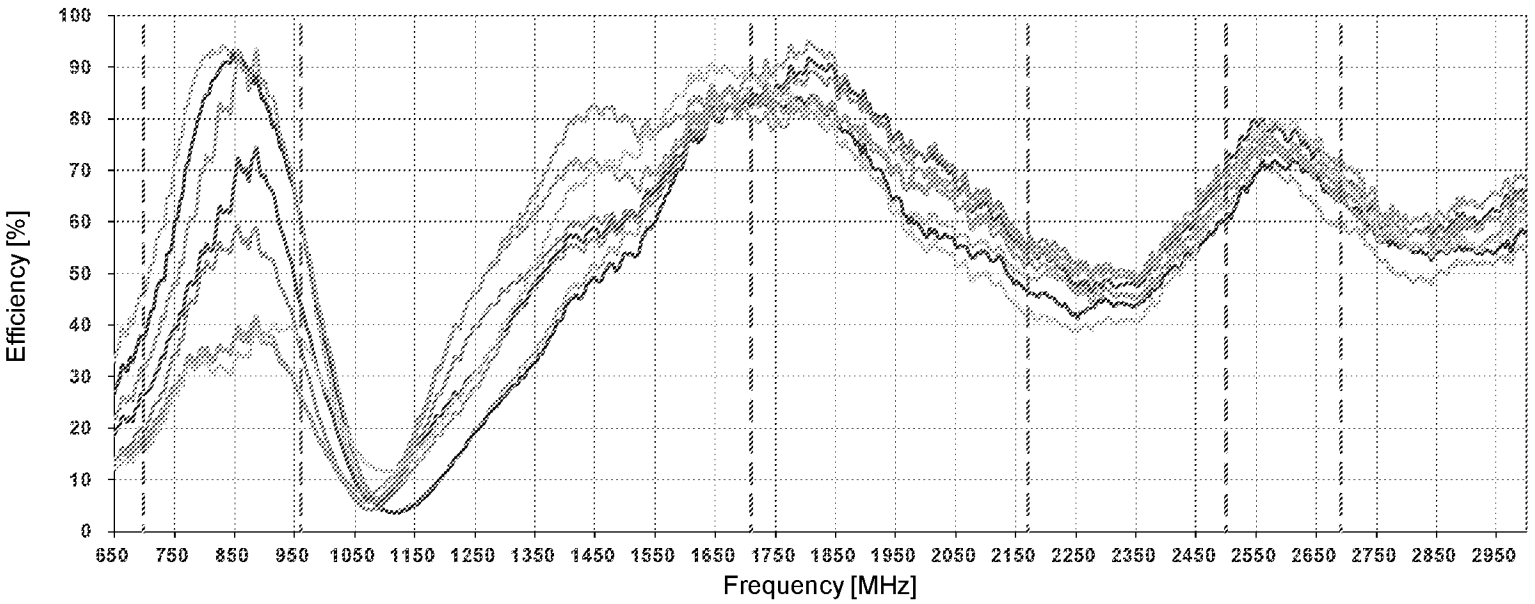
FIG. 7 shows simulated efficiencies of a stamped metal PIF A according to the first embodiment of the present teaching versus different ground plane sizes.

It should be noted that the length of the ground plane of the PCB on which a PIF A 200A is positioned can have an effect the electromagnetic radio frequency (RF) performance of the PIF A 200A. Conventionally, a larger ground plane is directly correlated to better antenna efficiency. By enabling a PCB to have a larger ground plane, such that the ground plane can extend under and within the volume of the PIF A, the RF performance of the PIF A 200A can be improved. With reference to FIG. 7, simulated efficiencies of a stamped metal PIF A according to the first embodiment versus different ground plane sizes are shown—the range of sizes extend from 5.5 cm to 13.5 cm with the best results being obtained for sizes between 12.5-13.5 cm, although it will be seen that ground planes as short as 5.5 cm can provide acceptable results.

It will be appreciated that variants of the above described embodiment are possible. For example, it is not necessary that the base portion 20C' extend beyond the fold line D-D to provide a support pin 80 which is subsequently bent in order to provide the required support when the PIF A 10 is positioned on a PCB. Instead, this support can be provided simply by the unbent end of the base portion resting directly on the PCB surface.

Figure 4:
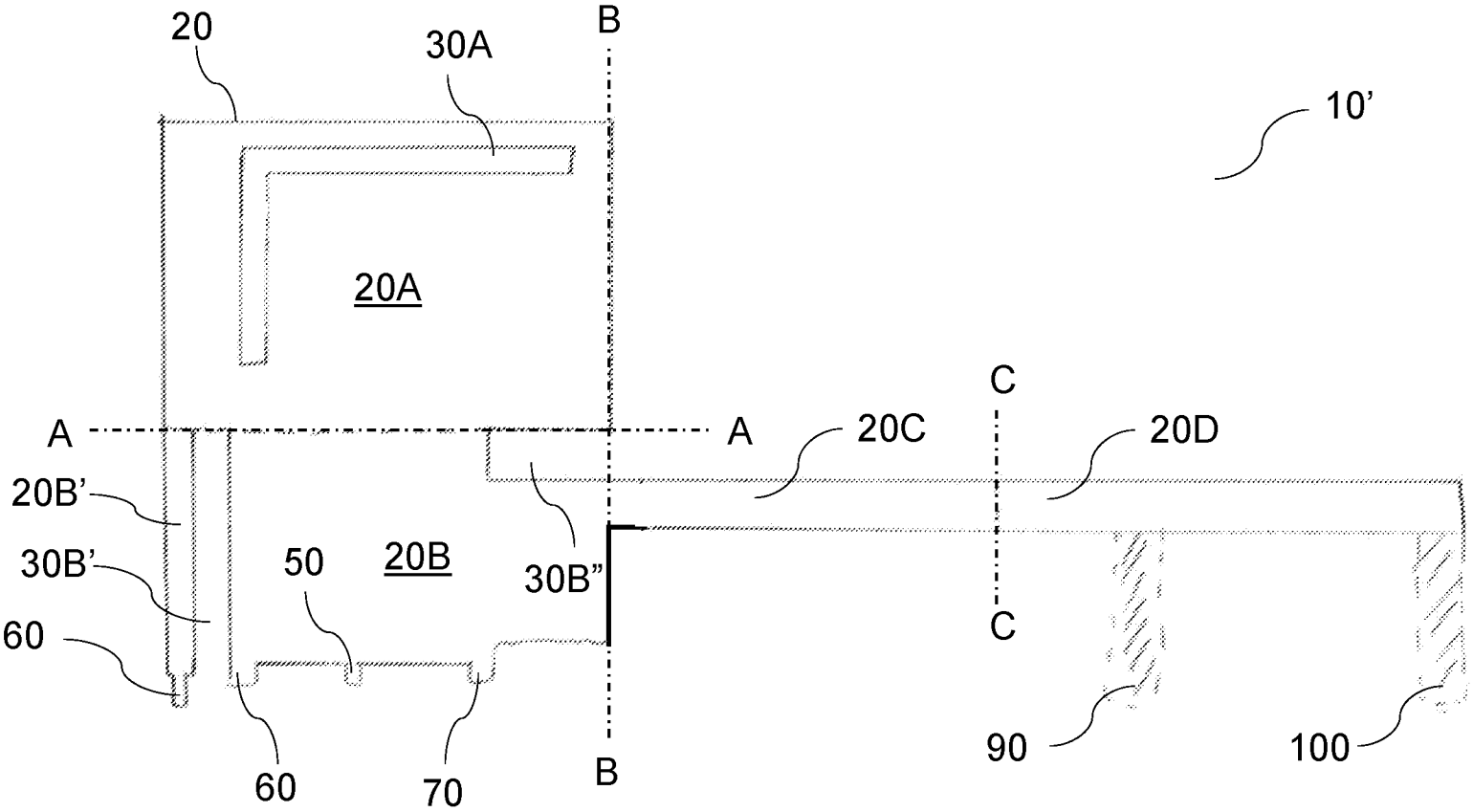
FIG. 4 is a development of PIF A according to a second embodiment of the present teaching.
Figure 6:
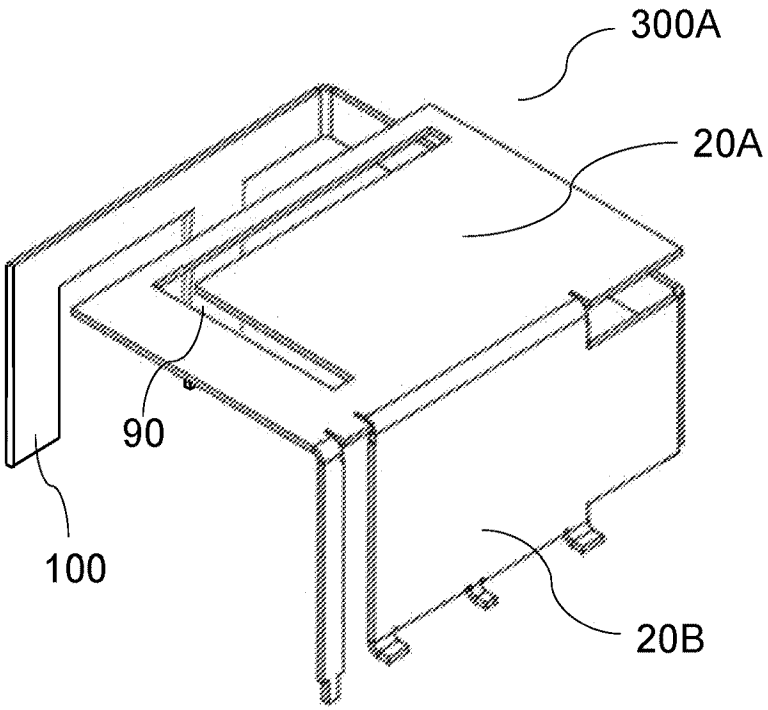
FIG. 6 is a second perspective view of the PIF A of FIG. 4 when folded.
Figure 5:
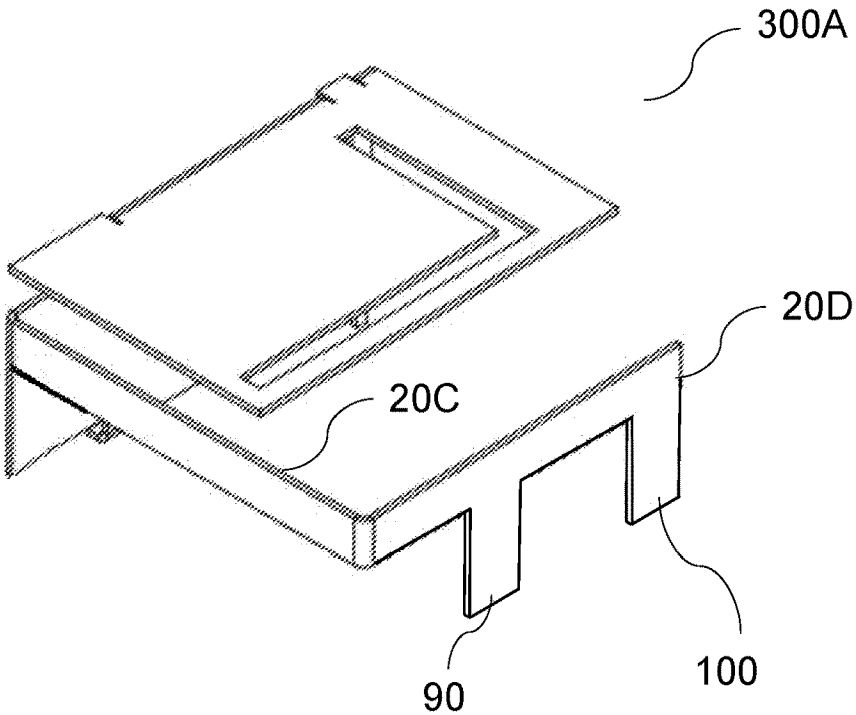
FIG. 5 is a first perspective view of the PIF A of FIG. 4 when folded.

Referring now to FIG. 4, there is shown an unfolded PIF A 10' according to a second embodiment, while FIGS. 5-6 show the PIF A 300A in a folded state. By comparison to the embodiment of FIGS. 1-3, the differences between the two embodiments comprise: removing the base portion 20C' of the embodiment of FIGS. 1-3 and providing instead a pair of legs 90, 100 depending from the fourth section 20D. Thus, these legs 90, 100 can support the PIF A 300A when located on a PCB.

Note that as in the background art, the expression PIF A is used in the present specification for an antenna providing equivalent antenna functionality to a flat PIF A, although the antenna comprises portions which are out of plane with one another.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A planar inverted-F antenna, the antenna comprising a sheet comprising conductive material, the sheet including:

a first section having a first slot defined therein, the first slot comprising:

a first leg running adjacent a first edge of the first section; and a second leg running adjacent a second edge of the first section;

a second section, the second section connected at a first edge of the second section to a third edge of the first section, the second section oriented at a first angle to the first section, the second section comprising:

a shorting leg separated from a remainder of the second section by a second slot, the shorting leg running along a second edge of the second section and terminating in a shorting pin extending from a third edge of the second section opposite the first edge of the second section; and a feed pin extending from the remainder of the second section along the third edge of the second section;

a third section, the third section connected at a first edge of the third section to a fourth edge of the second section, the third section oriented at a second angle to the second section; and a fourth section, the fourth section connected at a first edge of the fourth section to a second edge of the third section, the fourth section oriented at a third angle to the third section.

2. The antenna of claim 1, wherein the first, second, third, and fourth sections are folded relative to one another to define a volume.

3. The antenna of claim 1, wherein the second section is generally parallel to the fourth section.

4. The antenna of claim 1, wherein the first section is generally orthogonal to the second section.

5. The antenna of claim 4, wherein the second section is generally orthogonal to the third section, and wherein the third section is generally orthogonal to the fourth section.

6. The antenna of claim 1, wherein the second section additionally comprises a supporting pin extending from the remainder of the second section along the third edge of the second section.

7. The antenna of claim 6, wherein the feed pin and the supporting pin are bent out of plane of the second section.

8. The antenna of claim 1, wherein the first slot defines a path extending from the shorting leg around a periphery of the antenna.

9. The antenna of claim 1, wherein the first slot is an L-shaped slot.

10. The antenna of claim 1, additionally comprising a support connected to at least one of the third and fourth sections.

11. The antenna of claim 10, wherein the support comprises a supporting leg defined by a portion of the fourth section extending parallel to the first edge of the fourth section.

12. The antenna of claim 10, wherein the support comprises a supporting leg defined by a portion of the third section extending parallel to the first and second edges of the third section.

13. A planar inverted-F antenna, the antenna comprising a sheet comprising conductive material, the sheet including first, second, third, and fourth sections folded relative to one another to define a volume, the first section connected to and folded at a first angle to the second section, the third section connected to and folded at a second angle to the second section, and the fourth section connected to and folded at a third angle to the third section, wherein:

the second section comprises:

a shorting leg separated from a remainder of the second section by a linear slot, the linear slot running along a first outer edge of the second section opposite the third section, the shorting leg terminating in a shorting pin extending from a second outer edge of the second section opposite the first section; and a feed pin extending from the remainder of the second section along the second outer edge; and the first section comprises:

a slot having a first leg running adjacent a first outer edge of the first section adjacent the first outer edge of the second section, and a second leg running adjacent a second outer edge of the first section opposite the second section to define a path extending from the shorting leg around a periphery of the antenna.

14. The antenna of claim 13, wherein the second section is generally parallel to the fourth section.

15. The antenna of claim 13, wherein the second section additionally comprises a supporting pin extending from the remainder of the second section along the second outer edge of the second section, and wherein the feed pin and the supporting pin are bent out of the plane of the second section.

16. The antenna of claim 13, additionally comprising a support connected to at least one of the third and fourth sections.

17. The antenna of claim 16, wherein the support comprises a supporting leg defined by a portion of one of the third or fourth sections.

18. The antenna of claim 17, wherein a base of the supporting leg is coplanar with the second outer edge of the second section.

19. The antenna of claim 17, wherein the supporting leg is coplanar with a remainder of the one of the third or fourth sections.

20. The antenna of claim 13, wherein the third and fourth sections comprise a narrowed arm extending along an inner edge adjacent to and running round the first section.

* * * * *